US008742270B2

(12) United States Patent
Hatano et al.

(10) Patent No.: US 8,742,270 B2
(45) Date of Patent: Jun. 3, 2014

(54) SWITCH WITH LOCKING MECHANISM

(75) Inventors: Masaya Hatano, Nagakute (JP); Hiroyuki Okamura, Nagakute (JP)

(73) Assignee: Nitto Kogyo Corporation, Nagakute (JP)

( * ) Notice: Subject to any disclaimer, the term of this patent is extended or adjusted under 35 U.S.C. 154(b) by 234 days.

(21) Appl. No.: 13/348,084

(22) Filed: Jan. 11, 2012

(65) Prior Publication Data

US 2012/0186952 A1 Jul. 26, 2012

(30) Foreign Application Priority Data

Jan. 12, 2011 (JP) ..... 2011-003535

(51) Int. Cl.
*H01H 9/28* (2006.01)

(52) U.S. Cl.
USPC ..... 200/43.16

(58) Field of Classification Search
USPC ..... 200/43.16, 327, 321, 158, 43.21, 43.18, 200/318.1, 318.2, 50.19, 50.11, 50.16; 361/269, 144; 335/6–46, 129, 236, 335/205, 211, 224, 157, 158; 439/38, 39, 439/305, 950; 218/43
See application file for complete search history.

(56) References Cited

U.S. PATENT DOCUMENTS 3,906,814 A * 9/1975 Magnussen ..... 74/483 PB
3,940,578 A * 2/1976 Pointon ..... 200/5 A
4,203,013 A * 5/1980 Serras-Paulet ..... 200/5 A
4,703,294 A * 10/1987 Yokoyama et al. ..... 335/121

FOREIGN PATENT DOCUMENTS

JP 2010-67550 3/2010

* cited by examiner

*Primary Examiner* — Renee Luebke
*Assistant Examiner* — Harshad Patel
(74) *Attorney, Agent, or Firm* — Westman, Champlin & Koehler, P.A.

(57) ABSTRACT

The present invention provides a switch that can prevent a locking member from being lost, that allows easy operations of handle locking and unlocking, and that allows more secure handle locking. A switch of the present invention includes a fixed contact point, a moving contact point capable of making contact with the fixed contact point, a handle to move the moving contact point, and a locking lever to lock the handle. The handle is equipped integrally with an overhang portion. The overhang portion is formed with a notched portion. The locking lever is equipped integrally with a projecting portion. The locking lever is pressed upwardly by a spring. When the handle is at a first position, an operation of the handle is locked by engaging the projecting portion to the notched portion. When the handle is at a second position opposite to the first position, an operation of the handle is allowed by letting the projecting portion abut on a lower surface of the overhang portion.

4 Claims, 12 Drawing Sheets

SWITCH WITH LOCKING MECHANISM

The present application claims priority of Japanese patent application Serial No. 2011-003535, filed Jan. 12, 2011, the content of which is hereby incorporated by reference in its entirety.

BACKGROUND OF THE INVENTION

The present invention relates to a switch provided with a locking mechanism preventing a handle from being operated carelessly.

DESCRIPTION OF THE RELATED ART

Switches and breakers have a structure of opening and closing a contact point by operating a handle. Therefore, there is a possibility of opening or closing a contact point by carelessly applying an external force to a handle. In particular, when a handle at an OFF position is moved in an ON direction, there is a risk of letting a current flow in a circuit to electrically shock an operator during an inspection operation of the circuit. With that, as shown in Patent Document 1, conventional switches prevent a handle from being operated carelessly by mounting a separate locking member to the handle.

However, this switch described in Patent Document 1 has a structure of mounting a locking member to a handle only when it is desired to lock the handle, and upon operating the handle, the locking member is required to be removed from the handle. Therefore, there has been a possibility of losing the locking member removed from the handle. In addition, there has been a possibility of forgetting to remount the locking member to the handle after operating the handle, and it has been difficult to lock the handle always securely.

SUMMARY OF THE INVENTION

It is an object of the present invention to provide a switch that can prevent a locking member from being lost. It is also to provide a switch that allows easy operations of locking and unlocking. It is further to provide a switch that can carry out handle locking more securely.

The present invention to solve the above problems is as follows.

A switch, includes:

a fixed contact point;

a moving contact point capable of making contact with the fixed contact point;

a handle to move the moving contact point; and a locking member to lock the handle, wherein the handle is equipped integrally with an overhang portion, the overhang portion is formed with a notched portion, the locking member is equipped integrally with a projecting portion, the locking member is pressed upwardly by a spring, when the handle is at a first position, an operation of the handle is locked by engaging the projecting portion to the notched portion, and, when the handle is at a second position opposite to the first position, an operation of the handle is allowed by letting the projecting portion abut on a lower surface of the overhang portion.

It is preferred that the overhang portion hangs over towards the locking member and has an approximate arc shape.

It is preferred that the projecting portion protrudes towards the handle.

It is preferred that an arc barrier to reduce influence of heat due to an arc generated in the moving contact point is placed around the moving contact point.

The switch of the present invention preferably has the following configuration.

The switch further includes:

a fixed contactor having the fixed contact point equipped therewith; and a moving contactor having the moving contact point equipped therewith, wherein the fixed contactor and the moving contactor extend in directions opposite to each other sandwiching a contact point of the fixed contact point and the moving contact point, the fixed contactor and the moving contactor are equipped with respective iron pieces, and the iron pieces form a part of a magnetic path generated by a current flowing in the fixed contactor and the moving contactor.

A switch of the present invention includes a locking mechanism made with a handle and a locking member to lock the handle. The locking mechanism is built inside the switch. Accordingly, the switch of the present invention can prevent a locking member to lock the handle from being lost.

In the switch of the present invention, when the handle is at an OFF or ON position, the handle is locked automatically.

In the switch of the present invention, handle locking can be released by a simple operation of pressing down the locking member.

Accordingly, the switch of the present invention allows easy operations of handle locking and unlocking and thus handle locking can be carried out more securely.

The switch of the present invention has a structure where a locking member directly abuts on a handle. Accordingly, it is possible to arrange the locking mechanism made with the handle and the locking member in a slight space inside the switch, and it is possible to secure a space to install another mechanical unit.

Further, since the number of components configuring the locking mechanism is small, manufacturing costs for the switch can be reduced.

Around a moving contact point, an arc barrier may also be placed. The arc barrier is preferably placed at a position capable of surrounding a moving path of the moving contact point. By placing the arc barrier around the moving contact point, a case of the switch can be protected from heat of the arc generated when opening the contact point.

The fixed contactor and the moving contactor can be formed to extend in directions opposite to each other sandwiching a contact point of the fixed contact point and the moving contact point. In the fixed contactor and the moving contactor, an iron piece can be placed respectively. In this case, these iron pieces form a part of a magnetic path generated by the current flowing in the fixed contactor and the moving contactor. Accordingly, in a case of letting the current flow in the fixed contactor and the moving contactor, the fixed contact point and the moving contact point are pressed against each other by a magnetic force, so that it is possible to prevent the fixed contact point and the moving contact point from being separated from each other when a high current flows.

DESCRIPTION OF THE PREFERRED EMBODIMENTS

Preferred embodiments of the present invention are described below.

Figure 1:
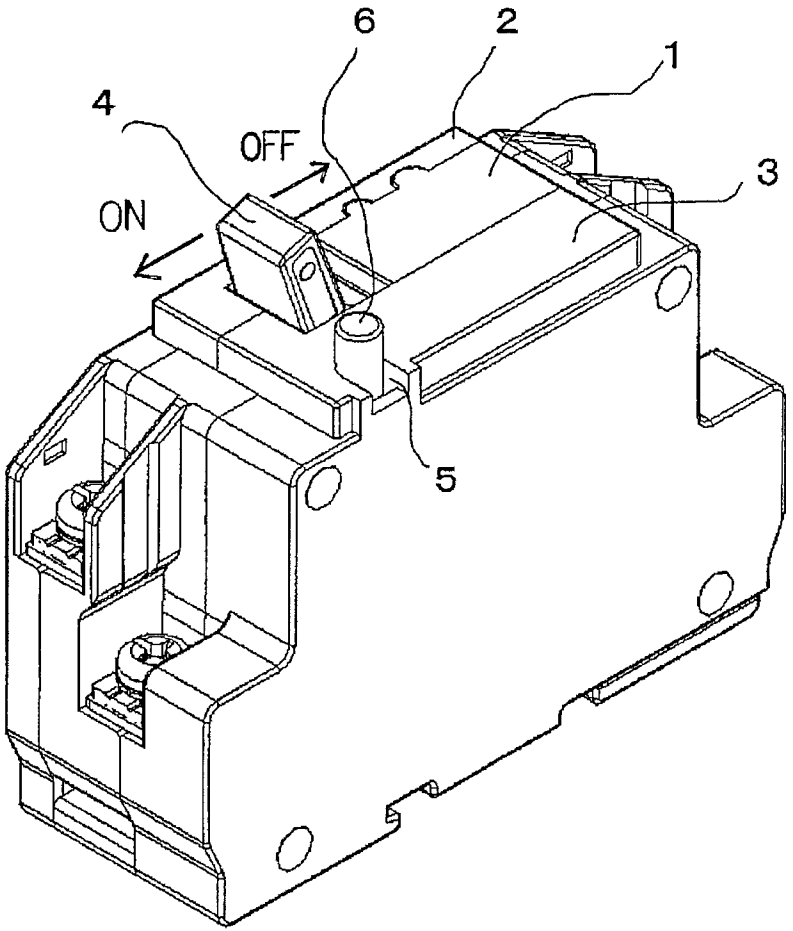
FIG. 1 is a perspective view illustrating an appearance of a switch according to an embodiment.

FIG. 1 is a perspective view of a double pole switch according to this embodiment.

As illustrated in FIG. 1, the switch is provided with a middle case 1, a right case 2, and a left case 3. On both sides of the middle case 1, the right case 2 and the left case 3 are arranged. Casing of the switch is configured with the middle case 1, the right case 2, and the left case 3. From an upper surface of the middle case 1, a handle 4 protrudes. Inside the left case 3, a cylindrical guide portion 5 is formed. A locking member 6 is stored in the guide portion 5 and is movable along the guide portion 5.

In FIG. 1, the lower left side is the ON direction when operating the handle 4 and the upper right side is the OFF direction. The ON direction is an upper side when installing the switch. To a terminal of the switch in the ON direction, a power supply, not shown, is connected.

Figure 2:
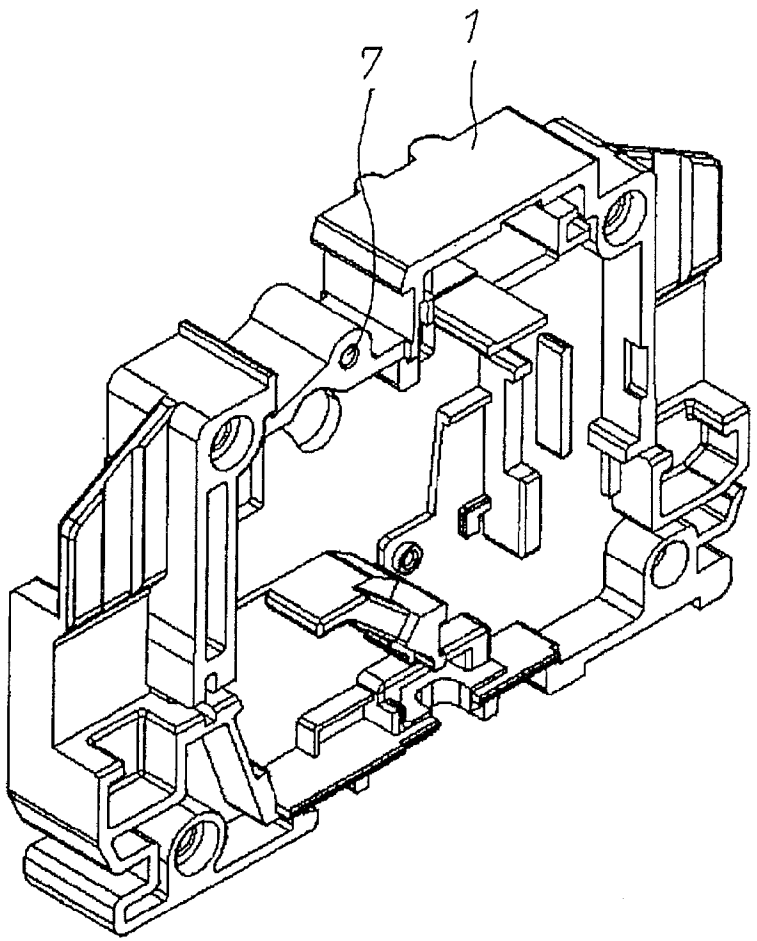
FIG. 2 is a perspective view illustrating an internal structure of a middle case.
Figure 3:
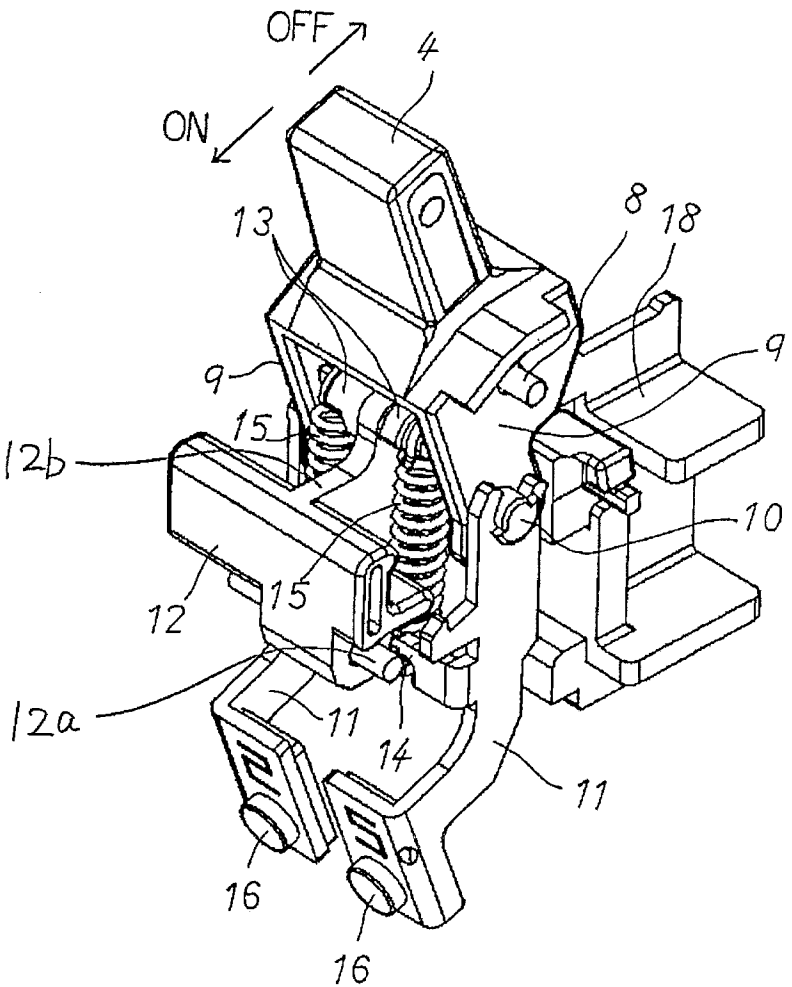
FIG. 3 is a perspective view of a handle.
Figure 4:
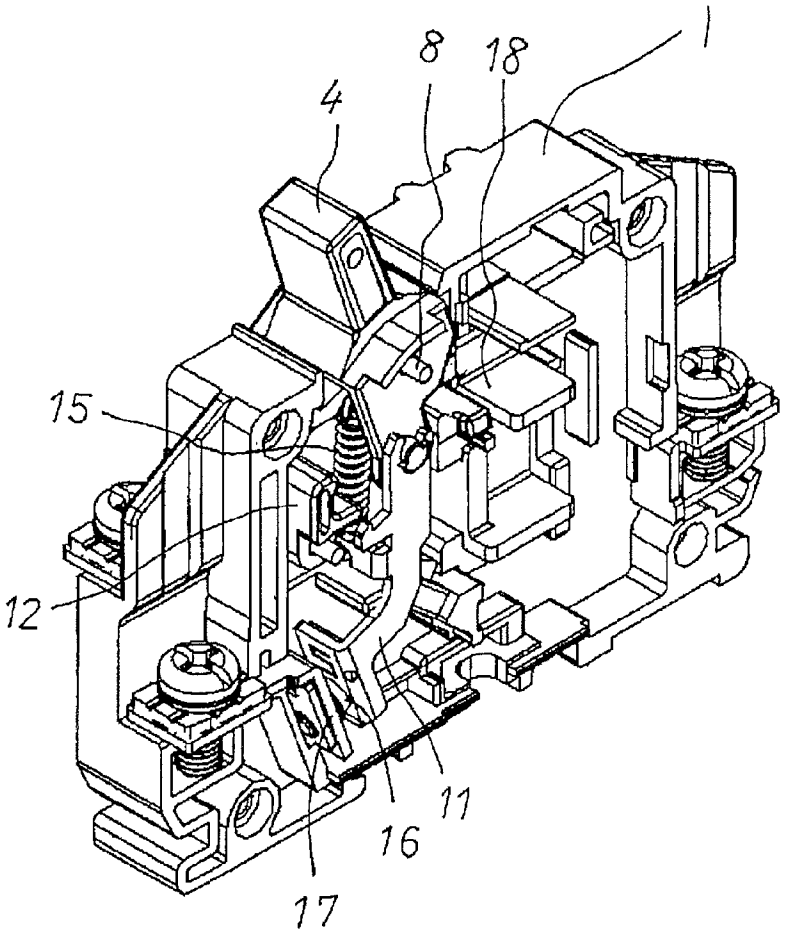
FIG. 4 is a perspective view illustrating an internal structure of a switch.

FIG. 2 is a perspective view illustrating an internal structure of the middle case 1. FIG. 3 is a perspective view of the handle 4. FIG. 4 is a perspective view illustrating an internal structure of the switch.

As illustrated in FIG. 2, in an upper portion of the middle case 1, a bore 7 to be a center of rotation of the handle 4 is formed. As illustrated in FIG. 3, the handle 4 is mounted to the bore 7 by a pin 8. The handle 4 is mounted so as to span across the middle case 1.

As illustrated in FIG. 3, the handle 4 is provided with a pair of leg portions 9. In the vicinity of lower ends of the leg portions 9, a shaft 10 is equipped. To this shaft 10, upper ends of moving contactors 11 are mounted.

The switch of this embodiment is a double pole type and is provided with two moving contactors 11 corresponding to the respective poles. The moving contactors 11 are arranged respectively on the left and right of the middle case 1.

As illustrated in FIGS. 3 and 4, at a lower portion of the handle 4, a cradle 12 is placed. The cradle 12 is fixed to the middle case 1 and the left case 3 by a pin 12*a*.

As illustrated in FIG. 3, the cradle 12 is provided with a pair of arm portions 13 protruding from both surfaces of a central wall 12*b*. Between the arm portions 13 and a hooking portion 14 equipped in between the moving contactors 11, springs 15 are mounted in a stretched state.

Figure 5:
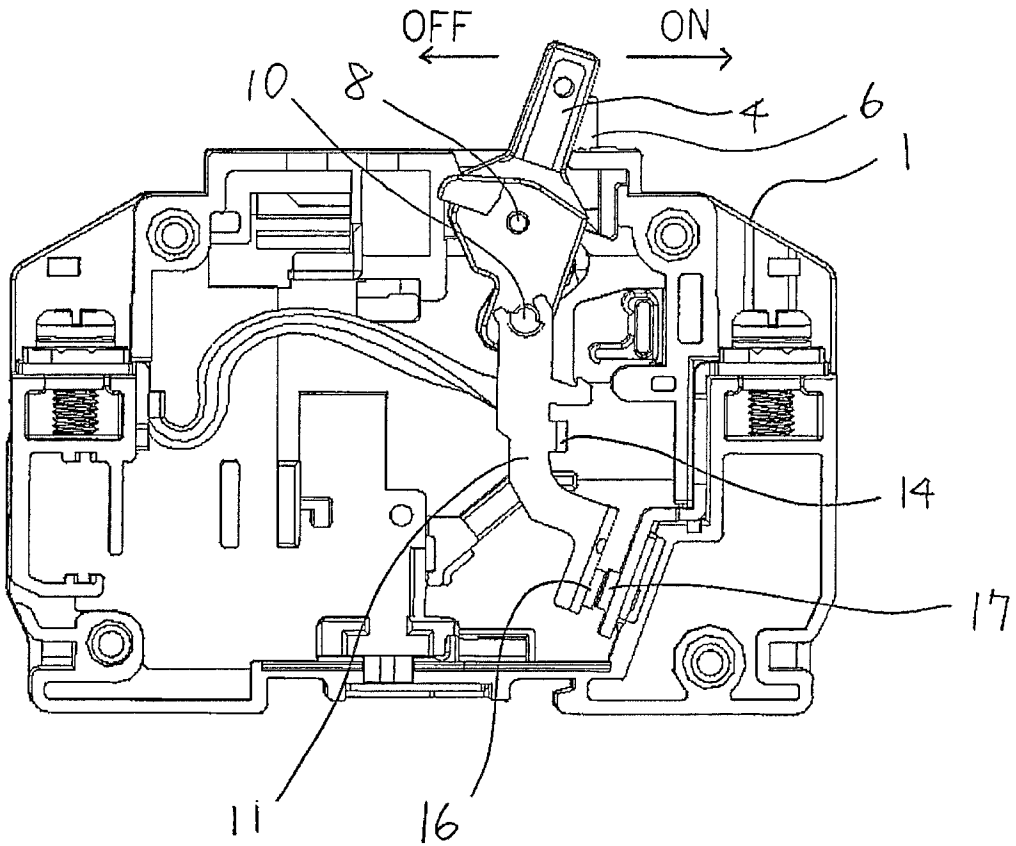
FIG. 5 is a side view of inside the switch and illustrates a state of operating the handle in an ON direction.
Figure 6:
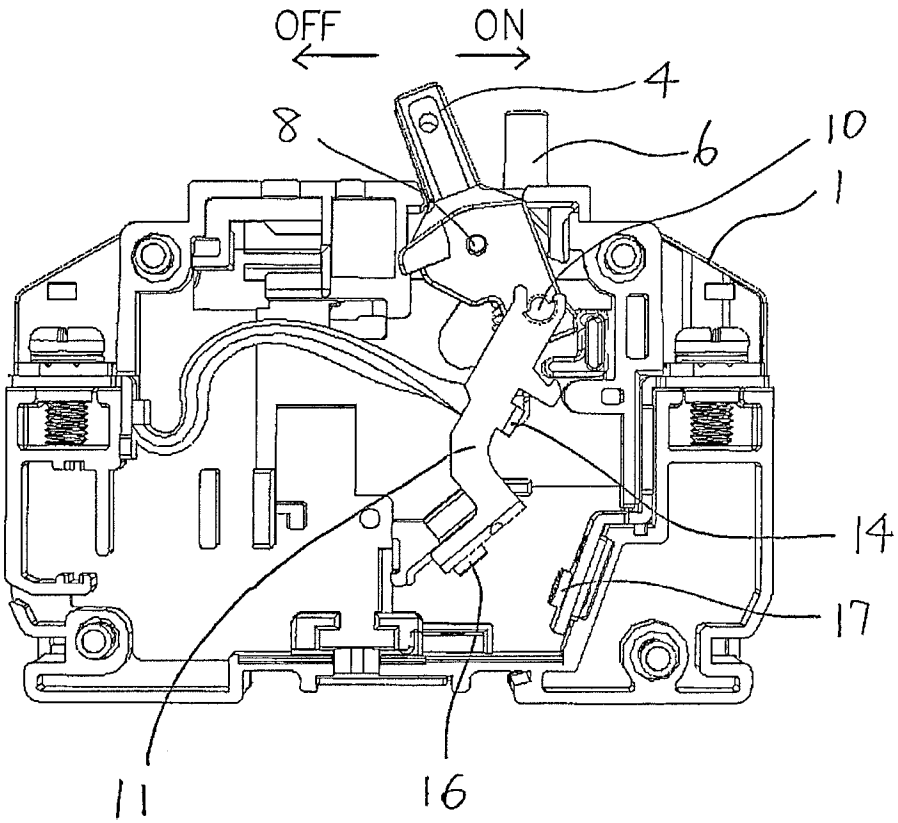
FIG. 6 is a side view of inside the switch and illustrates a state of operating the handle in an OFF direction.

FIG. 5 is a side view of inside the switch and illustrates a state of operating the handle in the ON direction. FIG. 6 is a side view of inside the switch and illustrates a state of operating the handle in the OFF direction.

As illustrated in FIG. 5, in a case of operating the handle 4 in the ON direction, the shaft 10 at the lower end of the handle 4 moves in the OFF direction. Then, as the shaft 10 moves in the OFF direction beyond a straight line (middle line) connecting the arm portions 13 and the hooking portion 14, the lower ends of the moving contactors 11 move in the ON direction (towards the power supply) due to the elastic force of the springs 15. This causes moving contact points 16 to make contact with fixed contact points 17 to turn ON the contact points.

As illustrated in FIG. 6, in a case of operating the handle 4 in the OFF direction, the shaft 10 at the lower end of the handle 4 moves in the ON direction. Then, as the shaft 10 moves in the ON direction beyond the straight line (middle line) connecting the arm portions 13 and the hooking portion 14, the lower ends of the moving contactors 11 move in the OFF direction due to the elastic force of the springs 15. This causes the moving contact points 16 to separate from the fixed contact points 17 to turn OFF the contact points.

As illustrated in FIGS. 3 and 4, a tip end of the cradle 12 is supported by a trigger hook 18.

The switch according to this embodiment is a double pole switch and is provided with a pair of moving contactors 11 corresponding to the two poles. In order to balance the pair of moving contactors 11, the pair of moving contactors 11 is required to be mounted respectively to one ends of the springs 15. As illustrated in FIG. 3, on both left and right sides of the cradle 12, arm portions 13 to mount the other ends of the springs 15 is equipped.

The switch may also be a single pole type. In a case of a single pole switch, the spring 15 may also be single. In a case of the single spring 15, neither the cradle 12 nor the trigger hook 18 is required. In this case, the upper end of the spring 15 may be caught by a pin or the like equipped at an upper portion of the handle.

In this embodiment, it is also possible to omit the trigger hook 18. In this case, the tip end of the cradle 12 can be supported by the middle case 1.

As described above, operations of turning ON and OFF the switch can be carried out by the handle 4. Accordingly, in order to maintain the state of contact points, a movement of the handle 4 may be locked by the locking member 6.

Figure 7:
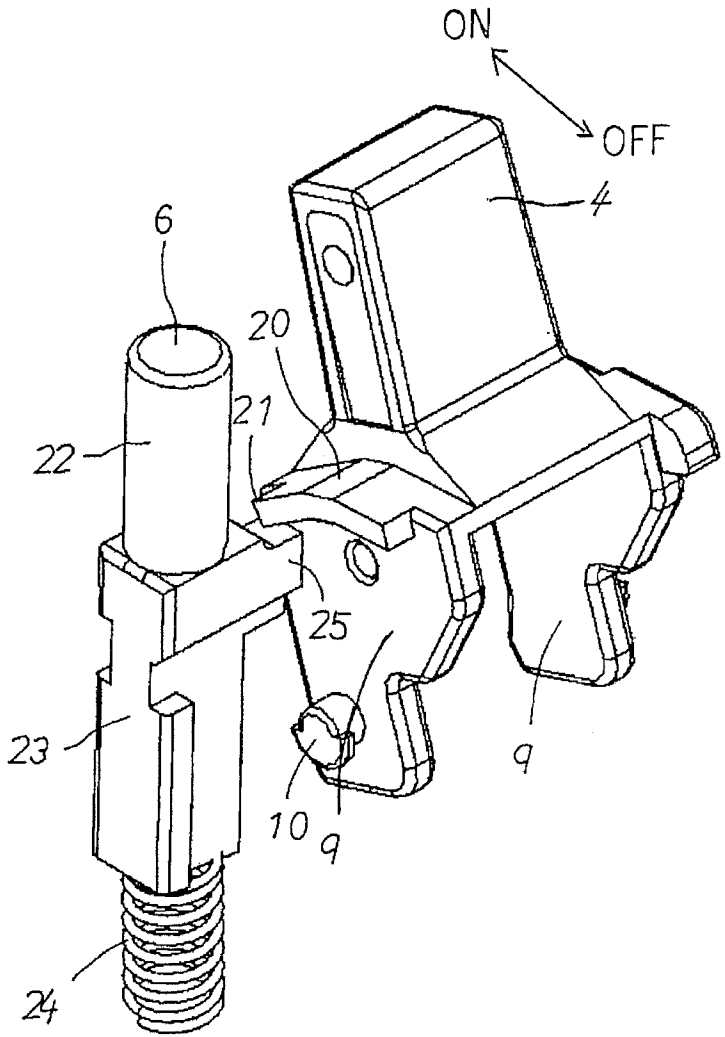
FIG. 7 is a perspective view of a locking mechanism and illustrates a state of not locking the handle.
Figure 8:
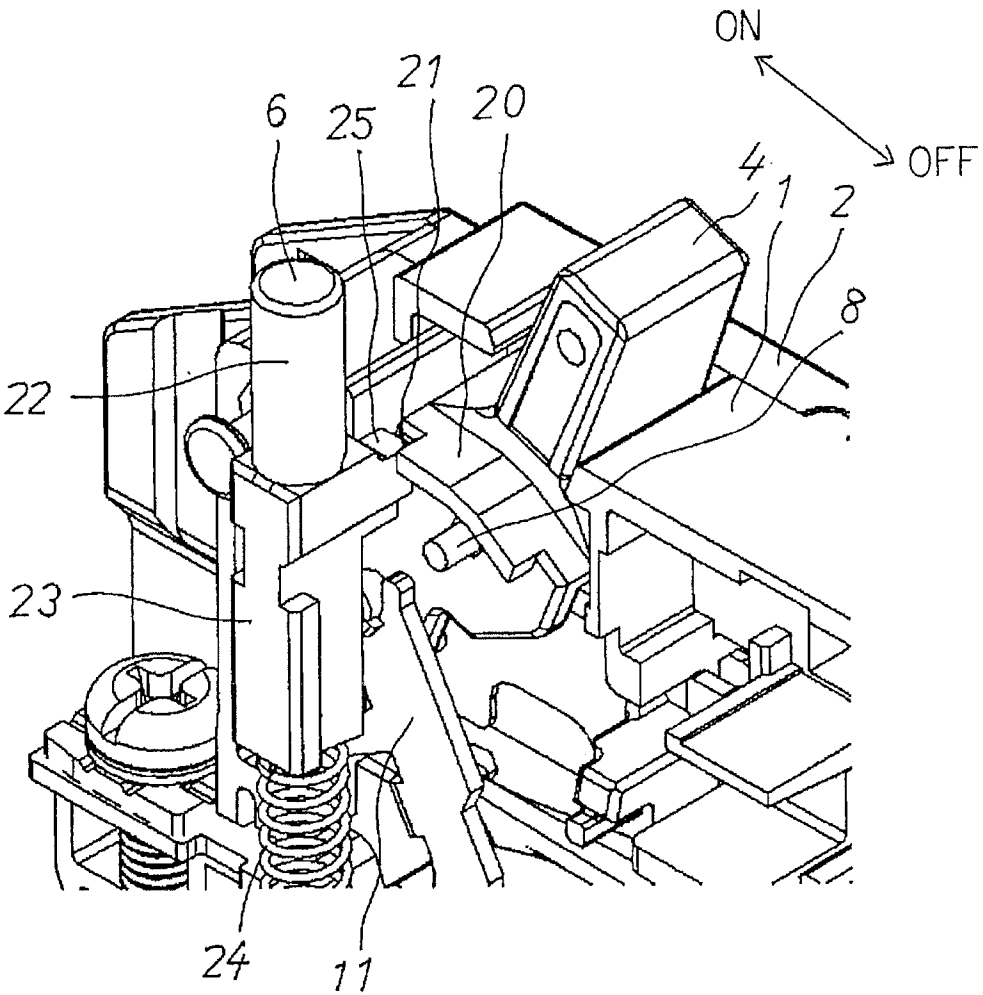
FIG. 8 is a perspective view of the locking mechanism and illustrates a state of locking the handle.

FIG. 7 is a perspective view of a locking mechanism and illustrates a state of not locking the handle 4. FIG. 8 is a perspective view of the locking mechanism and illustrates a state of locking the handle 4.

As illustrated in FIGS. 7 and 8, an overhang portion 20 is formed integrally on a side portion of the handle 4. The overhang portion 20 hangs over from the handle 4 towards the locking member 6. The overhang portion 20 has an arc shape. A center of the arc is the pin 8, which is a center of rotation of the handle 4. Also, the overhang portion 20 has a visor shape. In an end of the overhang portion 20, a notched portion 21 is formed. In this embodiment, the notched portion 21 is in a square shape.

In the present invention, the notched portion 21 is not necessarily formed in an end of the overhang portion 20. The notched portion 21 may be formed at a position corresponding to a projecting portion 25.

The locking member 6 is arranged at a position adjacent to the overhang portion 20. The locking member 6 is provided with a head portion 22 in a columnar shape protruding from an upper end of the guide portion 5 and a leg portion 23 in a rectangular columnar shape stored inside the guide portion 5.

To a lower end of the leg portion 23, a spring 24 made of metal is mounted. The spring 24 always presses the locking member 6 upwardly.

In an upper portion of the leg portion 23 of the locking member 6, the projecting portion 25 for locking is equipped. The projecting portion 25 protrudes from the locking member 6 towards the overhang portion 20 of the handle 4. The projecting portion 25 has a shape of a rectangular column As illustrated in FIG. 8, when the handle 4 is at a first position of (here, the OFF position), the projecting portion 25 engages with the notched portion 21. In this state, even when the handle 4 is tried to be moved in another direction (the ON direction), the projecting portion 25 bumps into an end surface of the notched portion 21, so that the handle 4 cannot be moved. Therefore, since the handle 4 is locked at the OFF position, the contact points are not to be turned ON.

By pressing down the head portion 22 of the locking member 6 downwardly with a finger, the projecting portion 25 moves below the overhang portion 20. Since this releases the engagement of the notched portion 21 and the projecting portion 25, the lock of the handle 4 is released to enable the handle 4 to be operated.

That is, in order to operate the handle 4 at the OFF position in the ON direction, the handle 4 is required to be operated while pressing down the locking member 6. This enables to prevent a careless operation of the handle 4.

As illustrated in FIG. 7, when the handle 4 is at a second position (here, the ON position) opposite to the first position, the locking member 6 is pressed upwardly by the elastic force of the spring 24, and the projecting portion 25 abuts on a lower surface of the overhang portion 20. As described above, the overhang portion 20 is formed in an arc shape. A center of the arc is the pin 8, which is a center of rotation of the handle 4. The lower surface of the overhang portion 20 is an arc surface. Therefore, the projecting portion 25 does not interfere with an operation of the handle 4. Consequently, when operating the handle 4 from the ON position to the OFF position, the operation of pressing down the locking member 6 is not required.

As the handle 4 is operated to the original first position (here, the OFF position), the projecting portion 25 goes up due to the elastic force of the spring 24 and is automatically fitted into the notched portion 21, and thus the handle 4 is locked again.

As described above, the switch with a locking mechanism of the present invention does not require mounting and removal of the locking member as conventional techniques. Therefore, there is no chance of losing the locking member removed from the handle. There is also no chance of forgetting to mount the locking member again to the handle after a handle operation.

Further, the switch of the present invention has the locking mechanism configured with a small number of components, which are the handle 4 and the locking member 6. Therefore, it is possible to manufacture the switch at low costs.

The switch of the present invention has a structure where the locking member 6 directly abuts on the handle 4. Therefore, it is possible to arrange the locking mechanism, made with the handle and the locking member, in a slight space inside the switch. It is also possible to secure a space of arranging other mechanical components and mechanisms inside the switch.

The above embodiment shows an example of a switch opening and closing a contact point by operating the handle 4. However, the present invention is applicable not only to a switch opening and closing a contact point but also to a breaker having a function of blocking a current. That is to say, the switch of the present invention also includes a breaker having a blocking function.

In a case of applying the present invention to a breaker, in order to block an overcurrent, it is preferred that the handle can freely move from the ON position to the OFF position.

The above embodiment shows an example of a switch having the locking member 6 arranged on the power supply side (ON side) relative to the handle 4 to lock an operation of the handle 4 from the OFF position to the ON position. However, the present invention is also applicable to a switch having the locking member 6 arranged on a load side (OFF side) relative to the handle 4 to lock an operation of the handle 4 from the ON position to the OFF position. This enables to prevent, for example, occurrence of a trouble of turning OFF an important power supply by mistake.

Figure 9:
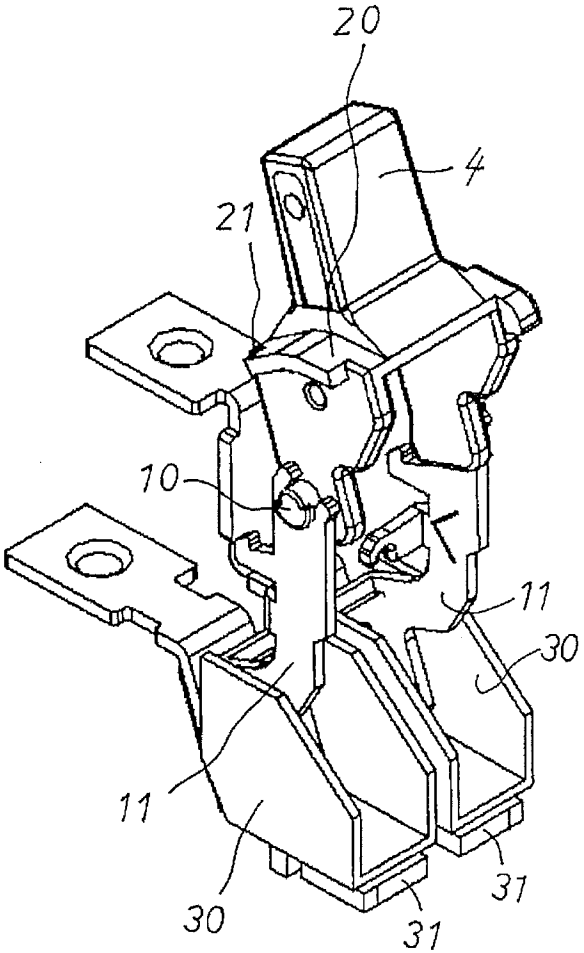
FIG. 9 is a perspective view illustrating arc barriers.
Figure 10:
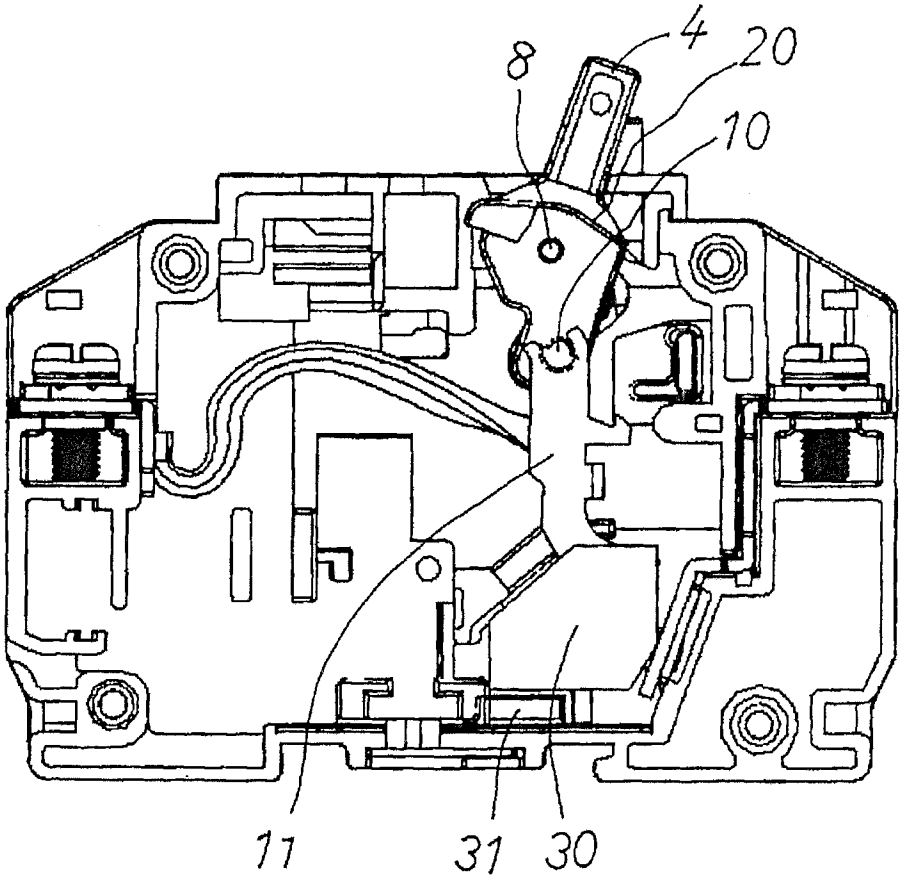
FIG. 10 is a side view of a switch having an arc barrier built therein.

As illustrated in FIGS. 9 and 10, around the moving contact points 16, it is preferred to place arc barriers 30 to reduce influence of heat due to the arc generated in the moving contact points 16. The arc barriers 30 are members to protect the cases from the heat of the arc generated when opening the contact points. The arc barriers 30 are preferably placed at positions capable of surrounding moving paths of the moving contact points 16.

The arc barriers 30 can be formed with, for example, a heat resistant acrylic resin. The arc barriers 30 are formed more preferably with polymethylpentene, polyamide, and the like generating an arc extinguishing gas when exposed to the arc.

As illustrated in FIG. 7, the arc barriers 30 are molded as a member separate from the cases. However, the arc barriers 30 can also be molded integrally with the middle case 1, the right case 2, or the left case 3 by two color molding or the like.

In a case of the arc barriers 30 being a member separate from the cases, it is preferred to form a heat insulating space between the arc barriers 30 and the cases to inhibit heat transfer to the cases.

As illustrated in FIGS. 9 and 10, between the arc barriers 30 and bottoms of the cases, it is preferred to place permanent magnets 31. The magnetic poles of the permanent magnets 31 are preferably directed to the moving paths of the moving contact points 16. In a case of the switch for direct current, the extension direction of the arc can be curved to either left or right by the magnetic forces of the permanent magnets 31. This enables the arc to make contact with the arc barriers 30 and to be extinguished more securely.

Even in a case where the orientation of the magnetic poles is reversed by mounting the permanent magnets 31 upside down, it is possible to curve the extension direction of the arc to either left or right and is possible to let the arc make contact with a side wall of the arc barriers 30.

In addition, even in a case of reversely connecting the power supply and the load relative to the switch, it is possible to curve the extension direction of the arc to either left or right by the permanent magnets 31 and is possible to let the arc make contact with a side wall of the arc barriers 30.

Figure 11:
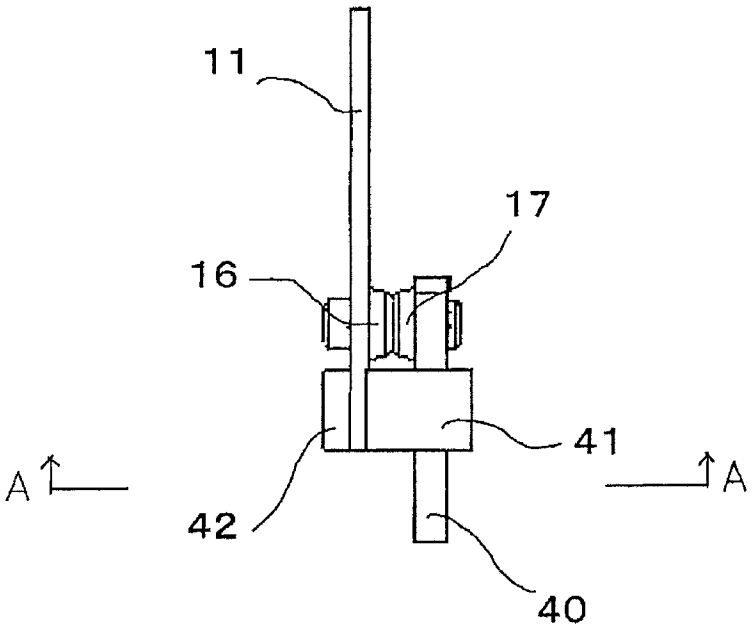
FIG. 11 is a side view of a fixed contactor and a moving contactor equipped with iron pieces.
Figure 12:
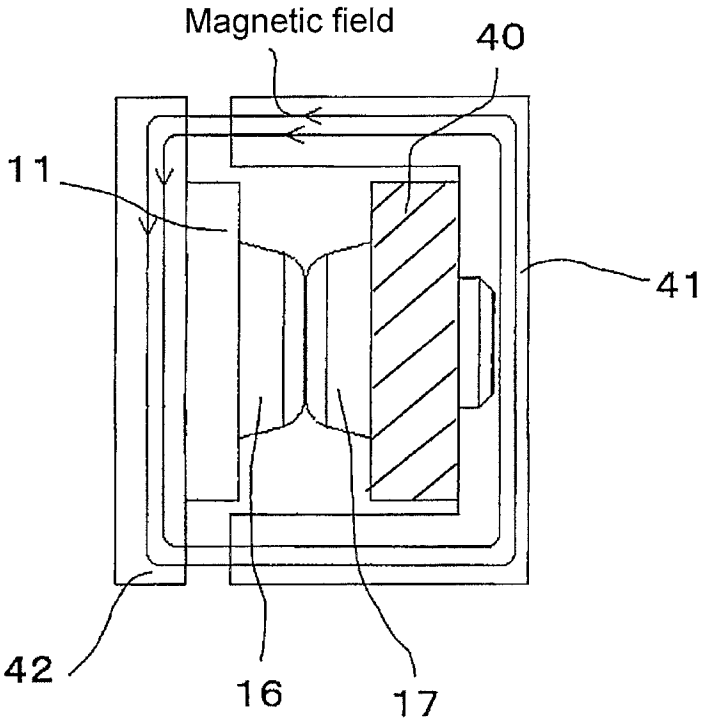
FIG. 12 is a cross-sectional view of the fixed contactor and the moving contactor equipped with the iron pieces and is a cross-sectional view corresponding to an A-A line in FIG. 11.

As illustrated in FIGS. 11 and 12, fixed contactors 40 and the moving contactors 11 can also be formed to extend in directions opposite to each other sandwiching the contact points of the fixed contact points 17 and the moving contact points 16. In this case, it is preferred to equip iron pieces 41 to the fixed contactors 40 and also to equip iron pieces 42 to the moving contactors 11. The two iron pieces 41 and 42 are preferably placed at positions facing each other.

As illustrated in FIG. 12, outside the fixed contactors 40, the iron pieces 41 having a cross section in an approximate U shape are mounted. Outside the moving contactors 11, the iron pieces 42 in a flat plate shape are mounted. Between the iron pieces 41 and 42, there is a slight clearance gap.

In a case of letting a current flow in the fixed contactors 40 and the moving contactors 11, the two iron pieces 41 and 42 form a part of the magnetic path. This causes generation of a magnetic force attracting each other between the two iron pieces 41 and 42, so that the moving contact points 16 and the fixed contact points 17 press against each other. As a result, in a case of letting a high current flow in the fixed contactors 40 and the moving contactors 11, it is possible to prevent the moving contact points 16 from being separated from the fixed contact points 17.

The iron pieces 41 and 42 are not necessarily placed so as to surround the fixed contactors 40 and the moving contactors 11. For example, the iron pieces 42 in a flat plate shape may also be mounted to surfaces opposite to the surfaces with the moving contact points 16 mounted thereto and the iron pieces 41 in a flat plate shape may also be mounted to surfaces opposite to the surfaces with the fixed contact points 17 mounted thereto.

The iron pieces 41 and 42 may also be mounted so as to surround the moving contact points 16 and the fixed contact points 17, respectively.

The switch with a locking mechanism of the present invention is applicable to all sorts of fields.

For example, the switch with a locking mechanism of the present invention can be used to open and close a circuit including a battery installed in an automobile.

REFERENCE NUMERALS

4 handle
6 locking lever
11 moving contactor
16 moving contact point
17 fixed contact point
20 overhang portion
21 notched portion
25 projecting portion
30 arc barrier
31 permanent magnet
40 fixed contactor
41, 42 iron piece Although the present invention has been described with reference to preferred embodiments, workers skilled in the art will recognize that changes may be made in form and detail without departing from the spirit and scope of the invention.

The invention claimed is:

1. A switch, comprising:

a fixed contact point;

a moving contact point capable of making contact with the fixed contact point;

a handle to move the moving contact point; and a locking member to lock the handle, wherein the handle is equipped integrally with an overhang portion, the overhang portion is formed with a notched portion, the locking member is equipped integrally with a projecting portion, the locking member is pressed upwardly by a spring, when the handle is at a first position, an operation of the handle is locked by engaging the projecting portion to the notched portion, when the handle is at a second position opposite to the first position, an operation of the handle is allowed, and the overhang portion hangs over towards the locking member and also has an approximate arc shape.

2. The switch of claim 1, wherein the projecting portion protrudes towards the handle.

3. The switch of claim 1, wherein an arc barrier to reduce influence of heat due to an arc generated in the moving contact point is placed around the moving contact point.

4. The switch of claim 1, further comprising:

a fixed contactor having the fixed contact point equipped therewith; and a moving contactor having the moving contact point equipped therewith, wherein the fixed contactor and the moving contactor extend in directions opposite to each other sandwiching a contact point of the fixed contact point and the moving contact point, the fixed contactor and the moving contactor are equipped with respective iron pieces, and the iron pieces form a part of a magnetic path generated by a current flowing in the fixed contactor and the moving contactor.

* * * * *